US009136068B2

(12) United States Patent
Connell

(10) Patent No.: US 9,136,068 B2
(45) Date of Patent: Sep. 15, 2015

(54) ELECTRICAL CONTACTOR

(71) Applicant: Johnson Electric S.A., Murten (CH)

(72) Inventor: Richard Anthony Connell, Hong Kong (CN)

(73) Assignee: JOHNSON ELECTRIC S.A., Murten (CH)

( * ) Notice: Subject to any disclaimer, the term of this patent is extended or adjusted under 35 U.S.C. 154(b) by 0 days.

(21) Appl. No.: 14/328,044

(22) Filed: Jul. 10, 2014

(65) Prior Publication Data

US 2015/0015349 A1 Jan. 15, 2015

(30) Foreign Application Priority Data

Jul. 11, 2013 (GB) ..... 1312462.3

(51) Int. Cl.
*H01H 67/02* (2006.01)
*H01H 3/00* (2006.01)

(52) U.S. Cl.
CPC ..... *H01H 3/001* (2013.01)

(58) Field of Classification Search
CPC ..... H01R 13/64
USPC ..... 335/136
See application file for complete search history.

(56) References Cited

U.S. PATENT DOCUMENTS

| | | | | | |
|---|---|---|---|---|---|
| 1,987,772 | A | * | 1/1935 | Eberhardt | 439/263 |
| 2,199,599 | A | * | 5/1940 | Stambaugh | 439/268 |
| 2,558,188 | A | * | 6/1951 | McWilliams | 200/573 |
| 2,907,848 | A | * | 10/1959 | Bengtsson | 335/126 |
| 3,346,710 | A | * | 10/1967 | Weston et al. | 218/97 |
| 3,643,202 | A | * | 2/1972 | Coon | 439/263 |
| 3,689,856 | A | * | 9/1972 | Lambert et al. | 335/133 |
| 3,842,228 | A | * | 10/1974 | Green | 218/117 |
| 4,230,388 | A | * | 10/1980 | Thierry et al. | 439/268 |
| 4,597,619 | A | * | 7/1986 | Reimer | 439/260 |
| 4,618,199 | A | * | 10/1986 | Pfaff | 439/266 |
| 5,021,760 | A | * | 6/1991 | Krubsack et al. | 335/196 |
| 5,805,039 | A | * | 9/1998 | Smith | 335/78 |
| 6,046,661 | A | * | 4/2000 | Reger et al. | 335/185 |
| 6,244,904 | B1 | * | 6/2001 | Fabian et al. | 439/656 |
| 6,409,553 | B1 | * | 6/2002 | Krause et al. | 439/757 |

(Continued)

FOREIGN PATENT DOCUMENTS

| | | |
|---|---|---|
| EP | 2613161 | 7/2013 |
| GB | 936142 | 9/1963 |

(Continued)

*Primary Examiner* — Shawki S Ismail
*Assistant Examiner* — Lisa Homza
(74) *Attorney, Agent, or Firm* — Muncy, Geissler, Olds & Lowe, P.C.

(57) ABSTRACT

An electrical contactor has a first terminal having an electrically-conductive fixed member with fixed contacts on opposite faces thereof, and a second terminal having a terminal body and an odd-number of electrically-conductive movable arms extending from the terminal body. Each movable arm has a movable contact thereon remote from the terminal body. The movable arms are arranged to oppose each other such that their movable contacts are on either side of the fixed member and aligned with the fixed contacts. The arrangement of the fixed member and the movable arms is such that, when the contacts close, current flowing through the movable arms produces a force which urges the movable arms towards each other thereby increasing a force between the fixed and movable contacts. The number of movable arms at each side of the fixed member is different.

29 Claims, 5 Drawing Sheets

(56) References Cited

U.S. PATENT DOCUMENTS

| | | | | |
|---|---|---|---|---|
| 7,780,457 | B2 * | 8/2010 | Schafer et al. | 439/76.1 |
| 7,833,034 | B2 * | 11/2010 | Connell | 439/251 |
| 8,040,664 | B2 * | 10/2011 | Makinson et al. | 361/661 |
| 8,658,921 | B2 * | 2/2014 | Therrien et al. | 200/52 R |
| 2005/0162149 | A1 * | 7/2005 | Makinson et al. | 324/142 |
| 2008/0186126 | A1 * | 8/2008 | Ying | 337/333 |
| 2009/0295371 | A1 * | 12/2009 | Pontin et al. | 324/142 |
| 2009/0318000 | A1 * | 12/2009 | Connell | 439/251 |
| 2013/0098744 | A1 | 4/2013 | Therrien et al. | |
| 2013/0178086 | A1 * | 7/2013 | Connell | 439/251 |

FOREIGN PATENT DOCUMENTS

| | | | |
|---|---|---|---|
| GB | 2413703 | A | 2/2005 |
| GB | 2413703 | B | 3/2007 |

* cited by examiner

ELECTRICAL CONTACTOR

CROSS REFERENCE TO RELATED APPLICATIONS

This non-provisional patent application claims priority under 35 U.S.C. §119(a) from Patent Application No. 1312462.3, filed in the United Kingdom on Jul. 11, 2013, the entire contents of which are hereby incorporated by reference.

FIELD OF THE INVENTION

This invention relates to an electrical contactor, particularly but not necessarily exclusively for high-current switching contactors employed in modern electricity meters, so-called 'smart meters', for performing a load-disconnect function at normal domestic supply mains voltages, typically being 100 V AC to 250 V AC. The invention may also relate to an electrical contactor of a high current switch which may be subjected to a high short-circuit fault condition requiring the contacts to not weld.

This invention therefore also relates to a two-pole electrical contactor, a movable electrical-contact set, a method of preventing or limiting electrical contact deflection on contact closure, and to a method of improving contact closure through preventing or limiting rotational clamping.

BACKGROUND OF THE INVENTION

In a fault condition with welded contacts, the electrical contactor provides "free" un-metered electricity to a premises. A dangerous shock hazard can also occur if the Load, that is thought to be disconnected safely, is still live at mains voltage.

Many known electrical contactors are capable of satisfactorily switching nominal current at around 100 Amps or 200 Amps for a large number of Load-switching cycles. The switching is undertaken by special silver-alloy contacts containing certain additives, which prevents welding. The switching blades or arms are configured to be easily actuated for the switching function, with minimal self-heating losses at the nominal currents concerned.

Most electricity meter specifications not only stipulate satisfactory nominal-current endurance switching lifetimes without the contacts welding, but also demand that at moderate short-circuit fault conditions they must also not weld, and must open on the next actuator-driven pulse. At much higher related "dead-short" conditions the switch contacts may weld, but must remain intact. In other words, not explode or emit any dangerous molten material during the "dead-short" duration, until protective fuses rupture or circuit breakers drop-out and safely disconnect the supply to the Load. This short-circuit withstand duration must be for a maximum of six cycles of the AC mains supply.

In North American electricity metering, domestic 2-phase supplies are fed via a three-wire cable from a heavy-duty street-side utility transformer to the metered premises at 115 V AC per phase, being 180 degrees apart, with-respect-to a central Neutral/Earth connection. For moderate loads at 115 V AC, each metered phase is fed via ring-main wiring to distributed sockets in the premises. However, all power-hungry loads such as washing machines, clothes driers, space heaters, pool heaters and air-conditioners, for example, are connected across both phases at 230 V AC, with a maximum Load capability of 200 Amps. Therefore, a robust 200 Amps two-pole contactor is required within the meter for performing the Load-disconnect function, as and when demanded.

In Europe and a majority of other territories worldwide, the dominant supply is single-phase 220 V AC at 100 Amps, and more recently 120 Amps, in compliance with the IEC 62055-31 specification. In North America and a few other countries using an equivalent system, the supply is two-phase 230 V AC at 200 Amps. This latter case is governed mainly by the ANSI C12.1 metering specification. Safety aspects are covered by other related specifications, such as UL 508, ANSI C37.90.1, IEC 68-2-6, IEC 68-2-27, IEC 801.3.

It is known from British patent 2413703 to BLP Components Limited of Newmarket, United Kingdom, to provide a bi-blade arrangement of parallel movable spring copper blades having movable contacts opposing a corresponding fixed contact. Opposing pairs of the spring copper blades are aligned with each other across the fixed contacts. In a basic 100 Amp switch, two spring copper blades and two fixed contacts are utilised, resulting in a total of four contacts with 50 Amps flowing in each parallel blade.

In a second higher nominal-current embodiment, constituting a 200 Amp switch, each spring copper blade is subdivided into two sprung sub-blades having a movable contact at each end. Each sub-blade is provided as part of a pair aligned and opposing each other across a fixed terminal member carrying associated fixed contacts. Each switch therefore has eight contacts, and a 2-pole 2-phase Load-disconnect contactor therefore comprises sixteen contacts in total.

Such current sharing between blades significantly reduces contact repulsion forces for more reliable switching, minimal self-heating, and non-welding at the higher Nominal and short-circuit currents.

A problem associated with the higher current 200 Amp 2-pole meter Load-disconnect contactor is the number of blades and contacts required. The increased number of blades necessitates a higher quantity of electrically conductive metal, in this case copper, and the increased number of contacts requires a greater silver content. This increases manufacturing costs substantially.

The known 100 Amp switch design from GB2413703 using simple parallel spring copper bi-blades is limited by the geometries and gap between each facing blade in the bi-blade set. Each bi-blade pair is capable of generating a certain magnetic attraction force at high shared current, one with-respect-to the other, balanced and acting against the contact repulsion forces. This ensures that the contacts remain closed during short-circuit faults. It is extremely difficult to configure the bi-blade pair to correctly balance the ratio of forces for a particular configuration, and given the limited space within the contactor casing. For the high current 200 Amp switch design, it was therefore convenient to utilise opposing aligned sub-blade pairs to achieve the desired switching characteristics.

SUMMARY OF THE INVENTION

Hence there is a desire for an improved electrical contactor or which at least provides a useful choice.

Accordingly, in one aspect thereof, the present invention provides an electrical contactor comprising a first terminal having an electrically-conductive fixed member with fixed contacts on opposite faces thereof; and a second terminal having a terminal body and an odd-number of electrically-conductive movable arms extending from the terminal body, each movable arm having a movable contact thereon remote from the terminal body; the odd-number of movable arms being arranged to at least substantially oppose each other and such that their movable contacts are on either side of the fixed member and aligned with the fixed contacts; the arrangement of the fixed member and the moveable arms being such that, when the contacts close, current flowing through the movable arms produces a force which urges the movable arms towards each other thereby increasing a force between the fixed and movable contacts.

The odd number of movable arms or blades disposed about each fixed member allows a reduction in the overall number of contacts of each switch, and therefore a reduction in electrically conductive material both for the inductors and the contacts.

Preferably, a first number of movable arms is provided at a first side of the fixed member, and a second number of movable arms opposing the first number of movable arms is provided at a second side of the fixed member, the first number of movable arms being greater than the second number of movable arms.

Preferably, two movable arms are provided at the first side of the fixed member, and one movable arm opposes the two movable arms and is provided at the second side of the fixed member.

Preferably, the movable contacts on the two movable arms are smaller than the movable contact on the one movable arm. This enables a reduction in over-lay material being utilised, which is typically a precious metal, such as silver.

Preferably, when the contactor closes, the movable contact on the one movable arm is arranged to close before the movable contacts on the two movable arms. This also enables a reduction in over-lay material.

Preferably, an overall lateral extent of the movable arms at one side of the fixed member is at least substantially equal to an overall lateral extent of the movable arms at the other side of the fixed member. By matching or substantially matching the overall lateral extents of the movable arms at each side of the fixed member, the switch can be balanced.

Preferably, each movable arm includes a distal extension element extending distally of the movable contact. This enables an end of each movable arm to be urged and braced and/or biased in position to more uniformly seat a corresponding movable contact with its counterpart fixed contact.

Beneficially, each distal extension element is angled outwardly relative to the movable contact. This thereby assists in counteracting a rotational clamping force imparted to portions of the movable blades proximally of the movable contacts resulting in contact tilt.

Preferably, an actuating arrangement is provided which includes an urging member for biasing each distal extension element against outward flexion.

Preferably, the urging member includes a plurality of upstanding members which are movable longitudinally of the movable arms.

Preferably, when in use, the urging member counteracts outward distal rotation of the movable contacts due to the force which urges proximal portions of the movable arms towards each other when the contacts are closed.

Preferably, the actuating arrangement further includes a separator member arranged to separate the movable arms thereby opening the contacts, the separator member being movable from a first position at which it causes separation of the movable arms to a second position at which the movable arms are movable freely towards the fixed member.

Preferably, the separator member is a wedge-shaped member movable longitudinally of the movable arms. Although a wedge-shaped member is preferred, any suitable separating means can be utilised to provide a predetermined gap between the movable and fixed contacts.

Preferably, the actuating arrangement includes a carriage which is movable relative to the movable arms, the urging member and the wedge-shaped member disposed on the carriage whereby the movable contact is interposed therebetween. This positioning either side of the movable contact assists with the movable contact being uniformly seated on the fixed contact.

Preferably, a dual-latching electromagnetic actuator is provided for causing the contacts to close and open. Latching of the actuator allows pulsed electrical drive, thereby reducing energy consumption. Dual latching enables the actuator to drive the movable and fixed contacts closed as well as open. Beneficially, the dual-latching electromagnetic actuator may include a ferrite magnetic element. However, two or more such magnetic elements may be utilised. Ferrite magnetic elements are cost-effective, allowing a production price to be lowered whilst still maintaining reliability and longevity.

According to a second aspect, the present invention provides a two-pole electrical contactor comprising: first and second sets of terminals; a first terminal of the first set being having an electrically-conductive fixed member with fixed contacts on opposite faces thereof; a second terminal of the first set having a terminal body and an odd-number of electrically-conductive movable arms extending from the terminal body, each movable arm having a movable contact thereon remote from the terminal body; the odd-number of movable arms being arranged to at least substantially oppose each other and such that their movable contacts are on either side of the fixed member and aligned with the fixed contacts; a further first terminal of the second set being having a further electrically-conductive fixed member with fixed contacts on opposite faces thereof; a further second terminal of the second set having a further terminal body and a further odd-number of electrically-conductive movable arms extending from the further terminal body, each movable arm having a movable contact thereon remote from the further terminal body; the further odd-number of movable arms being arranged to at least substantially oppose each other and such that their movable contacts are on either side of the further fixed member and aligned with the fixed contacts; the arrangement of the fixed members and the associated moveable arms being such that, when the contacts close, current flowing through the movable arms produces a force which urges the movable arms towards each other thereby increasing a force between the fixed and movable contacts.

Preferably, each second terminal comprises a pair of movable arms at one side of the fixed member aligned with a single movable arm at the other side of the fixed member.

Preferably, an overall lateral extent of the pair of movable arms at least substantially matches a lateral extent of the single movable arm.

Preferably, the movable contacts of the pair of movable arms are smaller than the movable contact of the single movable arm.

Preferably, the movable contact of each single movable arm is arranged to make contact with the associated fixed contact before the movable contacts of the corresponding pair of movable arms make contact with the associated fixed contacts when the contactor closes.

Preferably, each movable arm includes an out-turned distal extension element extending distally of the movable contact.

Preferably, an actuating arrangement is provided and arranged to open and close the contacts, the actuating arrangement including a movable urging element which biases the out-turned distal extension element against outward angular displacement relative to the fixed contact.

Preferably, a dual-latching electromagnetic actuator is provided for causing the contacts to close and open.

According to a third aspect, the present invention provides a movable electrical-contact set for an electrical contactor, the movable contact set comprising an odd-number of electrically-conductive movable arms and a fixed member interposed therebetween, the odd-number of movable arms each having a first contact thereon, and the fixed member having at least one second contact on each side for engagement with the facing first contacts such that, when the contacts close, current flowing through the movable arms produces a force which urges the movable arms towards each other thereby increasing a force between the first and second contacts.

Preferably, two movable arms are provided on one side of the fixed member, and a single movable arm is provided on the other side of the fixed member, an overall lateral extent of the two movable arms matching or substantially matching a lateral extent of the single movable arm.

Preferably, the first contacts on the two movable arms are smaller than the first contact on the single movable arm.

Preferably, each movable arm includes an out-turned distal extension element distally of each first contact.

Preferably, the movable arms extend substantially in parallel with each other to the first contacts.

The lateral extents of the movable arms at one side of the fixed member may be less than the lateral extent of the or each movable arm at the other side of the fixed member. Due to the odd number of movable arms and the requirement to preferably balance the switch, it is beneficial that the greater numbers of movable arms or blades at the one side of the fixed member are narrower than the or each opposing movable arm or blade at the other side.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
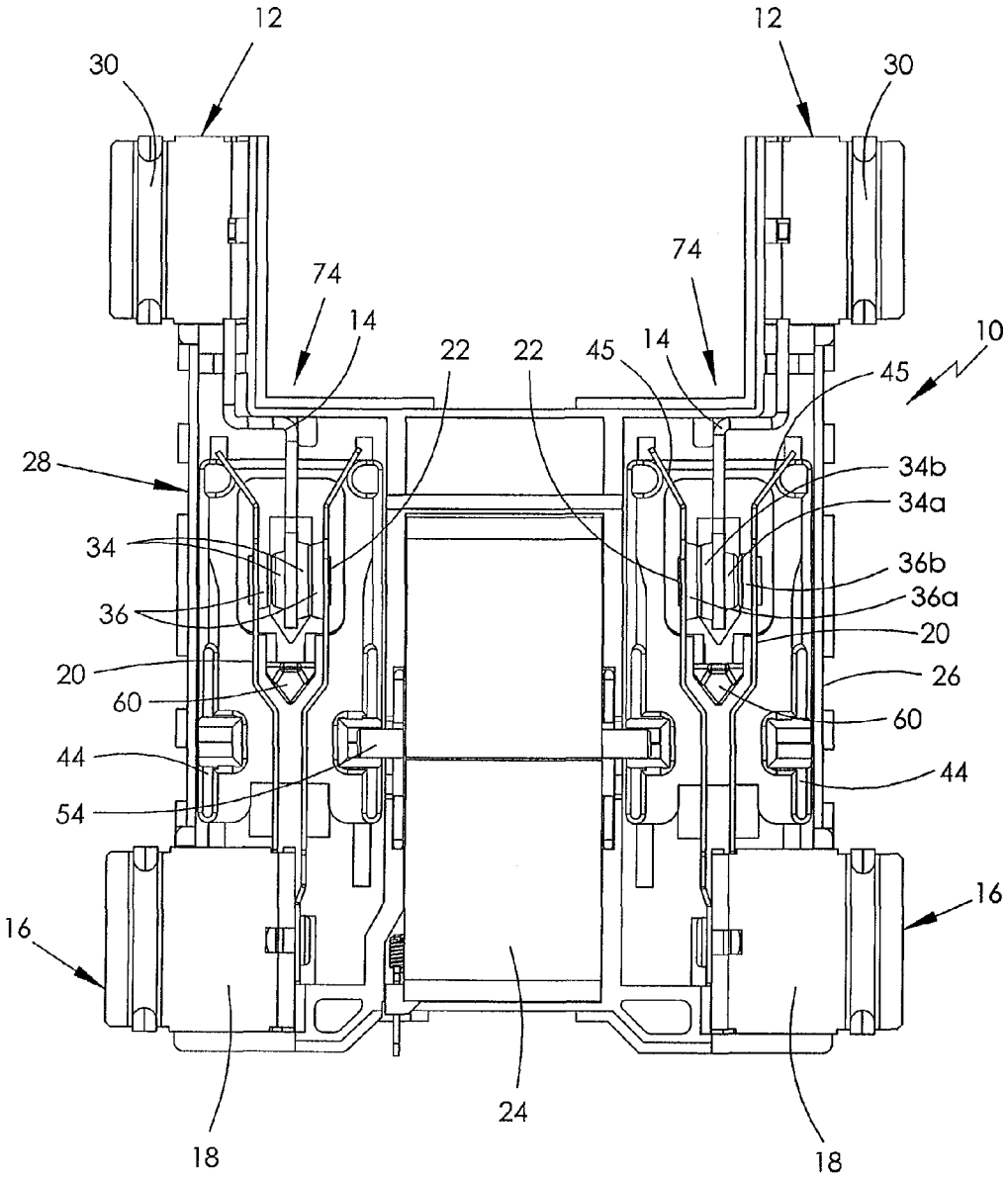
FIG. 1 shows a plan view of one embodiment of a 2-pole electrical contactor, in accordance with the present invention and shown with contacts closed.
Figure 2A:
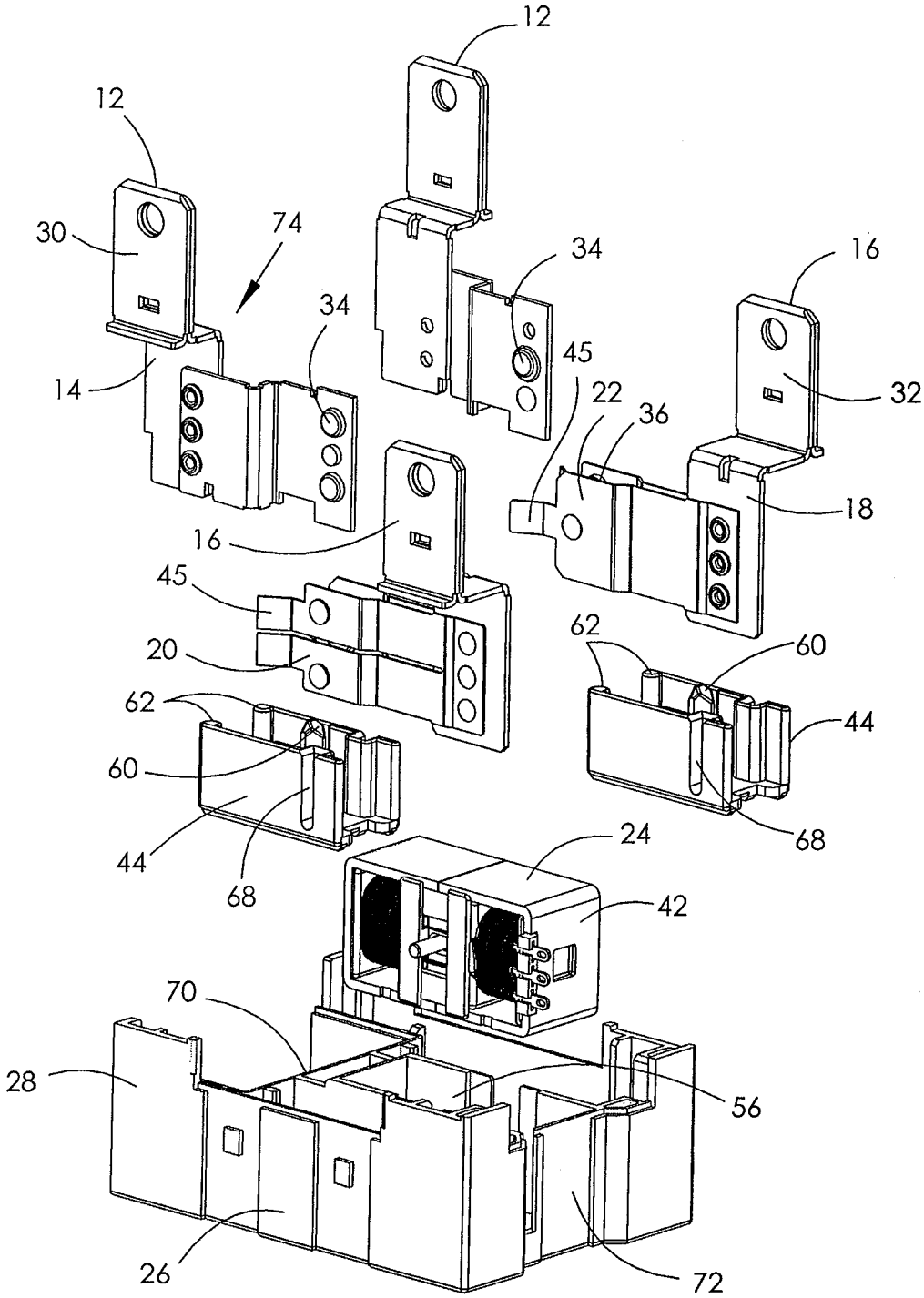
FIG. 2*a* is an exploded plan view of the electrical contactor, shown in FIG. 1.
Figure 2B:
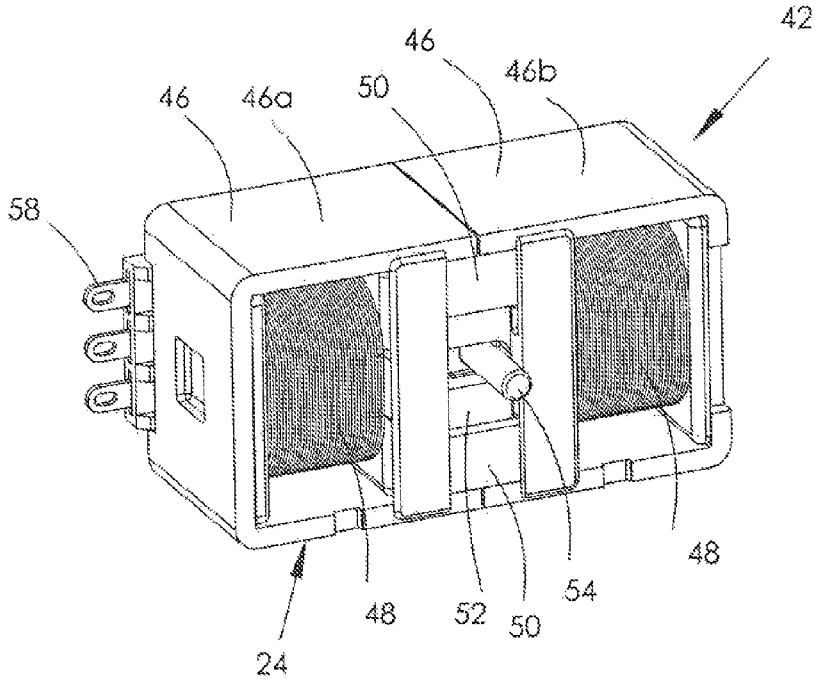
FIG. 2*b* is a side elevational view of a dual-latching electromagnetic actuator of the electrical contactor and which causes the contacts to open and close.
Figure 3:
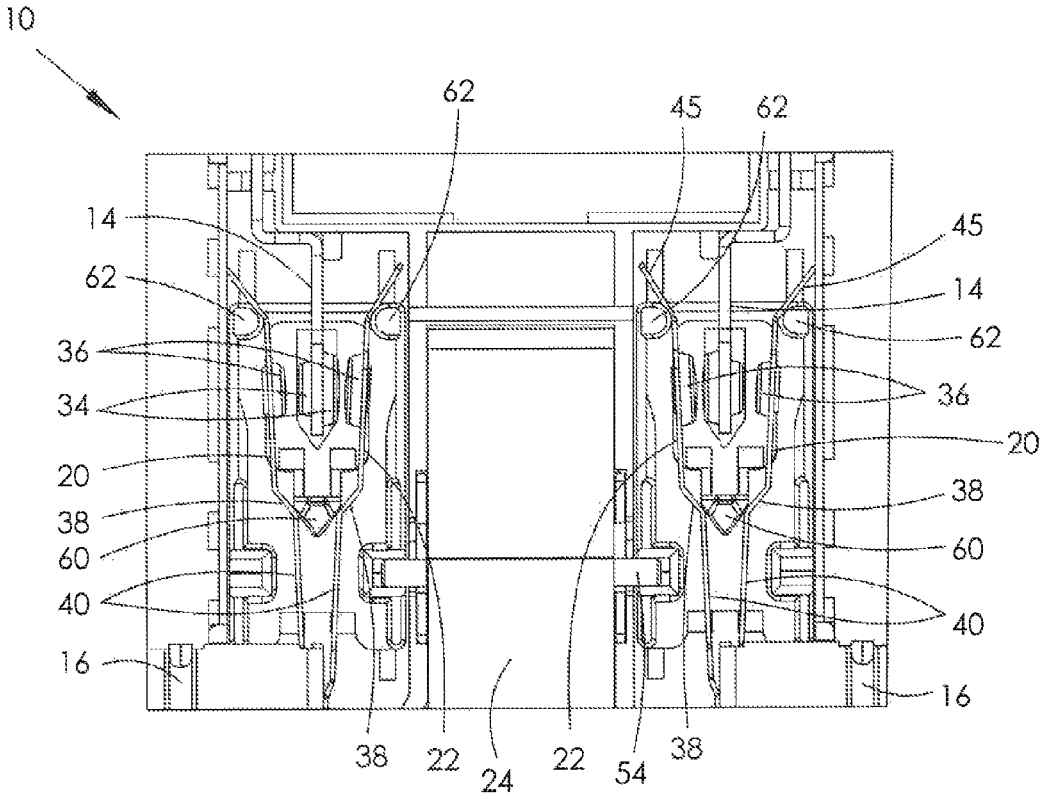
FIG. 3 is an enlarged view of an actuator arrangement and contact set of the electrical contactor, shown with the contacts open.
Figure 4:
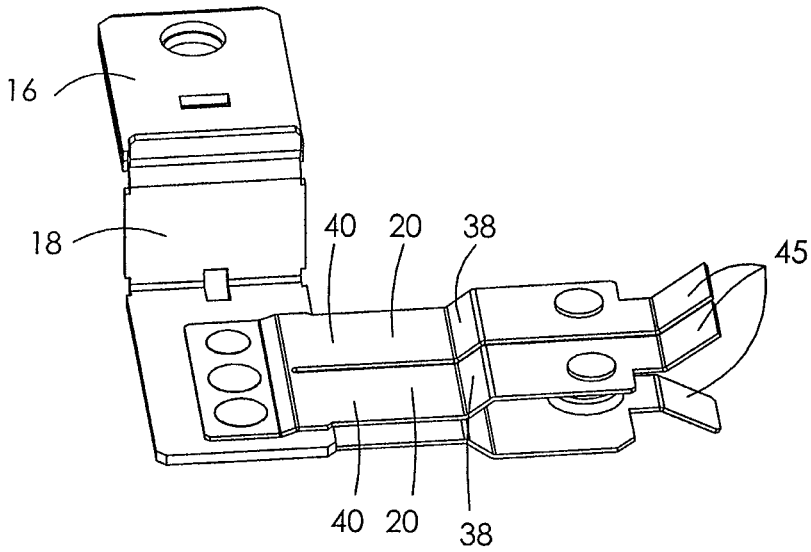
FIG. 4 is a side view electrically-conductive movable arms forming part of the contact set shown in FIG. 3.
Figure 5:
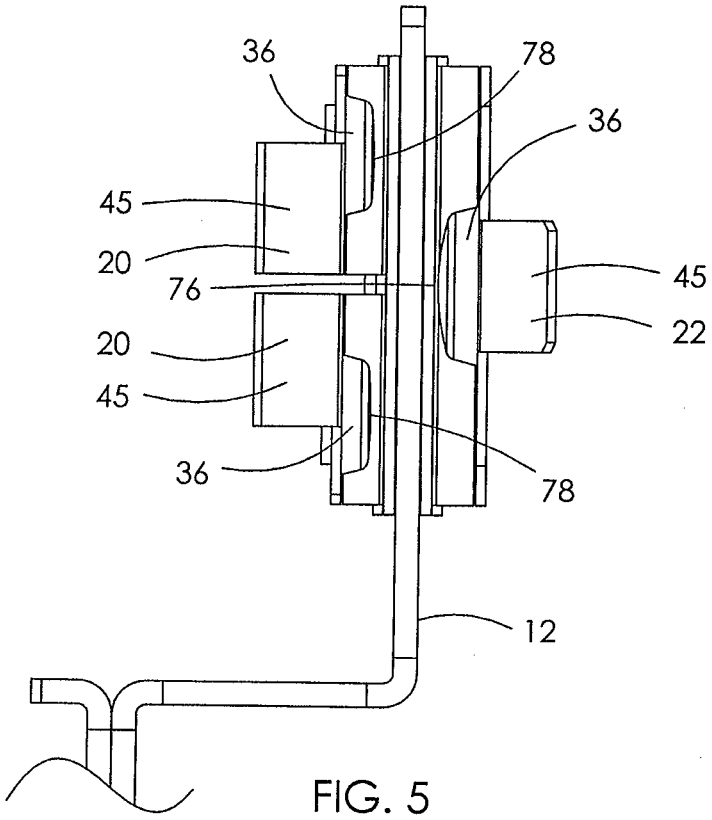
FIG. 5 is a distal end view of the movable arms with a fixed terminal member interposed therebetween, forming part of the contact set shown in FIG. 3.
Figure 6:
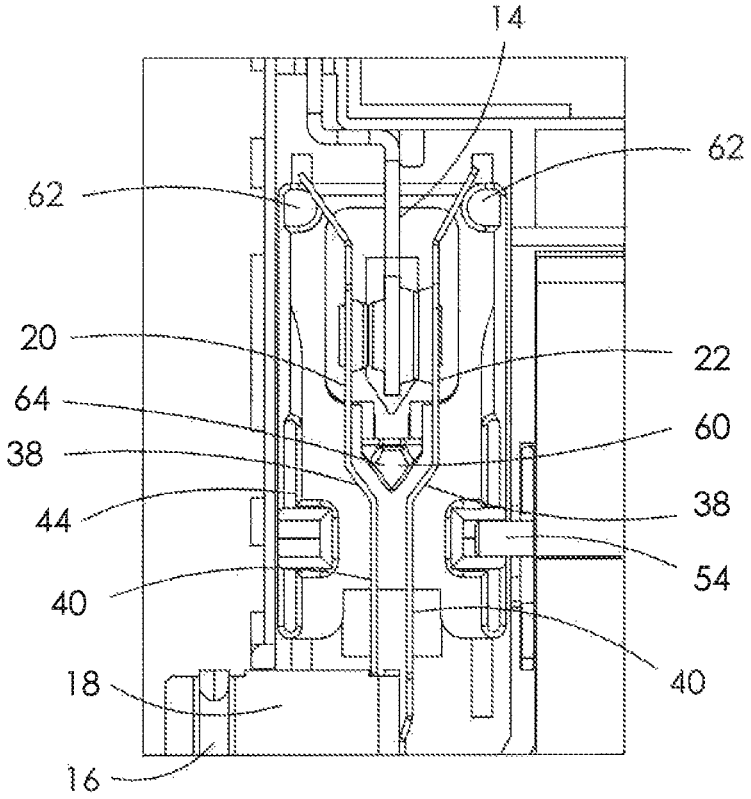
FIG. 6 is an enlarged view of the contact set of the electrical contactor, shown with the contacts closed.

Referring to the drawings, there is shown a 2-pole electrical contactor 10 which comprises two first terminals 12 each having a fixed member 14 of electrically conductive material, two second terminals 16 each having a terminal body 18 from which a plurality of cantilever movable arms 20, 22 also of electrically-conductive material extend to sandwich the fixed member 14, and an actuator arrangement 24 for moving the movable arms 20, 22 relative to the fixed members 14.

The first and second terminals 12, 16 are mounted to a base 26 of a housing 28, which in the drawings is shown with its cover removed. A first terminal pad 30 of each first terminal 12 and a second terminal pad 32 of each second terminal 16 extend from opposite ends of the housing base 26 in spaced apart relationship. The terminal pads are also known as stabs.

The electrically-conductive fixed member 14 extends perpendicularly from a proximal end of the first terminal pad 30, and has a dog-legged longitudinal extent contained by the housing base 26, terminating at or adjacent to the actuator arrangement 24.

A plurality of fixed contacts 34 is provided at or adjacent to a distal end of the fixed member 14. There is an odd number of fixed contacts 34, in this case being three, with two said fixed contacts 34*a* preferably being outboard and one said fixed contact 34*b* preferably being inboard. In this case, the two outboard fixed contacts 34*a* are spaced laterally outwards of the single inboard fixed contact 34*b*, which is positioned substantially on the central longitudinal axis of the fixed member 14.

Although a minimum number of fixed contacts 34 is three, a greater odd-number of fixed contacts 34 could be considered as necessity dictates.

The terminal body 18 of each second terminal 16 includes the second terminal pad 32 at or adjacent to its free distal end, and the electrically-conductive movable arms 20, 22 (or blades) extend perpendicularly or substantially perpendicularly to the terminal body 18 preferably from its proximal end. In this case, the movable arms 20, 22 are connected to the terminal body 18 at their proximal ends by riveting and/or brazing. However, the second terminal 16 could be formed as one-piece, or the connection may take place by any other suitable engagement means.

There is an odd-number of the movable arms 20, 22, in this case being three, each having a movable contact 36 partway there along and spaced from its free distal end. Each movable contact 36 is positioned between the midpoint and the free distal end of its associated movable arm 20, 22, and is arranged to face a corresponding fixed contact 34.

A pair of the movable arms 20 extend in parallel with each other towards an outboard side of the fixed member 14, and the remaining single movable arm 22 which opposes the pair of movable arms 20 extends towards an inboard side of the fixed member 14. Each movable arm 20 of the pair has a lateral extent which is less than that of the opposing single movable arm 22, and preferably an overall lateral extent of the pair of movable arms 20 matches or substantially matches that of the single movable arm 22.

Preferably, the movable contact 36*a* of the single movable arm 22 is larger than the movable contacts 36*b* of the pair of movable arms 20.

Each movable arm 20, 22 is also substantially dog-legged, providing a ramped or sloped shoulder 38 partway along its length and proximally of the associated movable contact 36. An attractive flexible portion 40 is therefore defined between the shoulder 38 and the proximal end of each movable arm 20, 22.

Extending in a distal direction, and in this case forming an end portion of each movable arm 20, 22, is a distal extension element 45. The distal extension element 45 is preferably an elongate tang which may be conveniently angled outwardly away from the fixed member 14. A lateral extent of the distal extension element 45 is also preferably less than a lateral extent of each movable arm 20, 22 to enable optimization when counteracting induced flex caused by the attractive flexible portions 40.

The actuator arrangement 24 comprises a dual-latching electromagnetic solenoid actuator 42 and two slidable carriages 44. The dual-latching actuator 42 includes a two part actuator housing 46 having opposing spaced solenoid coils 48 therein, ferrite magnets 50 in this case being plate magnets top and bottom, and a drivable plunger 52 carrying a drive arm or pin 54.

The actuator housing 46 is sized to fit tightly in an actuator compartment 56 of the housing base 26, and an electrical input connector 58 is provided at one side to receive a corresponding electrical output connector from an electrical feed to the electrical contactor 10.

The first and second parts 46*a*, 46*b* of the two-part housing 46 are preferably square-section and substantially U-shaped to house their respective solenoid coils 48. The profile being deep-drawn and having open sides provides beneficial flux linkage with the ferrite magnets 50, whilst also reducing the dynamic mass. As such, an attack response of the drive arm 54 between latched ends when the plunger 52 is driven via the solenoid coils 48 at nominal voltage is improved.

The slidable carriages 44 sit either side of the actuator compartment 56 on the housing base 26. Each carriage 44 includes a separating member 60 and an urging member 62. The separating member 60 in this case is an upstanding elongate wedge element 64 which is centrally positioned partway between lateral ends of the carriage 44, in this case being offset more towards one lateral end than the other. The wedge element 64 is adapted to force the movable arms 20, 22 and therefore the contacts 34, 36 apart to a predetermined gap.

The urging member 62 in this case is an upstanding elongate pin or roller 66, and two such urging members 62 are provided at or adjacent to opposing corners of one lateral end of the carriage 44.

With the carriages 44 in place, the drive pin 54 of the dual-latching actuator 42 is received in a pin opening 68 formed in a side wall of each carriage 44. The fixed member 14 extends partway over the carriage 44 and centrally between the urging members 62, so as to be spaced from the wedge element 64. This positions the fixed contacts 34 between a plane of the urging members 62 and the wedge element 64.

The movable arms 20, 22 extend over the carriage 44 from the other lateral end, with the shoulders 38 opposing the wedge element 64, and the distal extension elements 45 opposing their respective urging members 62. This positions the movable contacts 36 also between the plane of the urging members 62 and the wedge element 64, and additionally facing their respective fixed contacts 34.

In operation, the dual-latching actuator 42 is driven to a first latch position towards a first terminal end 70 of the housing base 26 whereby the odd-number of movable contacts 36 and fixed contacts 34 close. Due to the movable arms 20, 22 not being pre-loaded or inherently spring biased towards their corresponding fixed contacts 34, movement of the carriage 44 causes the urging members 62 to advance and thus urge the contacts 34, 36 closed.

The force at the contacts 34, 36 is also increased by the movable arms 20, 22 being arranged to be electrically parallel with each other, whereby, at a high shared short-circuit fault current, magnetic force generated at the flexible portions 40 causes augmented attraction.

However, this attractive force, due to the flex of the movable arms 20, 22, also potentially causes the movable contacts 36 to tilt relative to the fixed contacts 34, thereby not providing parallel seating or imparting so-called contact wiping. To this end, the out-turned distal extension elements 45 being positioned distally of the movable contacts 36 counter this rotational clamping effect by being braced and/or biased against their respective urging members 62.

When the dual-latching actuator 42 is driven to a second latch position towards a second terminal end 72 of the housing base 26, the carriage 44 slides causing the wedge element 64 to move into engagement with the shoulders 38 whilst withdrawing the urging member 62, thus forcing the contacts 34, 36 apart.

The distal extension elements or tangs 45 are movable and biasable by the urging members 62 to prevent or limit the possibility contact deflection during contact closure. This can be a particular issue if a short-circuit current is very high, for example, during AC peaks. Flexion of the movable arms 20, 22 may be great enough that they touch and thus cause the movable contacts 36 to rebound or bounce away from their respective fixed contacts 34. This can result in momentary opening of the switch with potentially catastrophic explosive consequences, along with the potential for causing tack-welds. The distal positioning of the urging members 62 with the outward pre-loading of the movable arms 20, 22 allows the urging members 62 to bring the movable contacts 36 into positive and controlled engagement with the respective fixed contacts 34, and to positively retain the contacts 34, 36 in this closed condition. Longevity of the contact set 74 is thus improved, with less likelihood of delamination of the contacts 34, 36.

In relation to the bi-blade prior art arrangement, the movable arms 20, 22 of the current invention can be shorter, narrower and thinner due at least in part to the use of the distal extension elements 45 and the associated urging members 62. As such, a significant saving in electrically conductive material can be made over the prior art arrangement. Such movable arms 20, 22 also provide a lower nominal switch resistance in the region of 0.1 milliohm, which is typically half that of the bi-blade prior art arrangement.

Due to the use of the improved movable arms 20, 22 providing lower resistances, a material thickness of the terminal pads 30, 32 of the first and second terminals 12, 16 can be changed from a traditional tooled thicker blank of material to a thinner blank of material which is then folded to meet regulatory thickness requirements. This reduces a mass of electrically conductive metal, whilst still maintaining a required pad to pad resistance which is less than 0.2 milliohm.

The wedge element 64 is preferably configured to open the movable arms 20, 22 to a pre-set contact gap in a preferred range of 0.6 mm to 1.0 mm, to meet a limiting open-contact voltage-breakdown requirement. The urging members 62 are preferably configured to impart a pre-set clamping force, preferably equal to or greater than 500 gF on each contact.

For arrangements which utilise multiple contacts for even current sharing at nominal or high short-circuit fault levels, it is important that the contacts used have adequate top-lay silver-alloy thickness in order to withstand the arduous switching and carrying duties involved, thus reducing contact wear. The above-referenced prior art arrangement utilizing up to sixteen contacts has a silver-alloy top-lay thickness of an 8 mm diameter bi-metal contact in a range 0.65 mm to 1.0 mm. This results in a considerable silver cost.

Consequently, it is preferred that the electrical contactor 10 of the present invention utilizing an odd-number of movable arms 20, 22 in order to reduce a number of contacts 34, 36 incorporates a lead/lag switching procedure. In this arrangement, the wider single movable arm 22, in this case being inboard of the fixed member 14, is designated as the switching lead arm, and the narrower pair of movable arms 20, in this case being outboard of the fixed member 14 and opposing the single movable arm 22, is designated as the switching lag arms.

As such, the larger movable contact 36 of the single movable arm 22 may have a diameter of 8 mm with a silver top-lay 76 in a region of 0.8 mm. However, the smaller movable contacts 36 of the pair of movable arms 20 may have diameters of 6 mm, providing the thermal mass of the movable arms 20, 22 is adequate, with a silver top-lay 78 in a region of 0.4 mm each. Since the switching lag arms 20 do not bear the brunt of the load current, wear is minimal and thus the top-lay material can be reduced without loss of performance or longevity.

Utilizing the urging members 62 and/or pre-loading of the movable arms 20, 22, the lead/lag switching procedure can be pre-set such that, during a pulse-drive of the dual-latching actuator 42, a defined fractional time delay is introduced between the closing of the movable contact 36 of the single switching lead arm 22 with its fixed contact 34*b* on the one side and the closing of the movable contacts 36 of the pair of switching lag arms 20 with their respective fixed contacts 34*a* on the other side.

A contact set of the electrical contactor described above, comprising the odd-number, in this case three, movable arms and the fixed member therebetween could be utilised alone with the actuator arrangement having a single carriage for a single-pole electrical contactor.

The movable arms may or may not be pre-loaded to a contact open or closed condition. If pre-loaded to a contact closed condition, then the separating member positively biases the movable arms away from each other when the contacts are open. If pre-loaded to a contact open condition, then the urging member positively biases the movable arms towards each other to increase a force between the closed contacts.

Although the distal end extensions are preferably directed outwardly away from the fixed member, the distal end extensions may be straight. To this end, although the urging member is preferred as a peg or roller, any other suitable bracing or biasing means may be utilised, and a single bracing or biasing means may be used to brace and/or bias the movable arms on both sides of the fixed member.

Furthermore, it has been described that the contact sets utilise two narrower movable arms on one side of the fixed member and a single wider movable arm on the other side. However, other odd number may be considered, such as three narrower movable arms on one side of the fixed member and two wider movable arms on the other side.

While all embodiments show wedge shaped members employed for separating the arms (and contacts) for opening the switch or switches in the case of a two-pole contactor, any member capable of performing the separating or open switch function, for example pegs or rollers acting on the inside faces of the inclined portions of the arms, may be employed.

Generally alternative members for separating and/or urging the arms together would remain integral with the carriage attached to the solenoid plunger, the stroke and actuation geometry being chosen to achieve the correct open/close switch functions, as required. This is not, however, essential and actuating arrangements where the members acting directly on the movable contact arms are independently movable could be employed.

The member acting directly on the movable arms or blades may be moved by any convenient actuation device. Any suitable motive force may be applied, for example a carriage could be moved by an electric motor or by any suitable mechanical means including manually activated mechanical means such as a lever.

It is thus possible to provide an electrical contactor which utilises an odd-number of movable arms to achieve a reduction in electrically conductive material utilised whilst also a lower electrical resistance in each switch. A contact set of such an electrical contact provides for a first number of movable contacts at one side of a fixed contact carrier, and a second number which is different to the first number at another side of the fixed contact carrier. By having substantially matching overall lateral extents on both sides, the contact set remains balanced. Furthermore, it also possible to reduce a top-lay material thickness of a number of the movable contacts by configuring the associated movable arms to lag behind a leading movable arm during a switching process. By utilizing distal end extensions on the movable arms, it is also possible to impart a more controlled closing force to the contacts, whilst also preventing or limiting contact deflection. It is further possible to improve the seating of the movable contacts on the fixed contacts by the use of the distal end extensions being braced and/or biased by the urging members. A reduction in size of the movable arms also allows a smaller housing to be utilised, whilst utilizing ferrite magnets decreases costs and allows dual latching.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of example only, and various other modifications will be apparent to persons skilled in the field without departing from the scope of the invention as defined by the appended claims.

In the description and claims of the present application, each of the verbs "comprise", "include", "contain" and "have", and variations thereof, are used in an inclusive sense, to specify the presence of the stated item or feature but do not preclude the presence of additional items or features.

The invention claimed is:

1. An electrical contactor comprising a first terminal having an electrically-conductive fixed member with fixed contacts on opposite faces thereof; and a second terminal having a terminal body and an odd-number of electrically-conductive movable arms extending from the terminal body, each movable arm having a movable contact thereon remote from the terminal body;

the odd-number of movable arms being arranged to at least substantially oppose each other and such that their movable contacts are on either side of the fixed member and aligned with the fixed contacts;

the arrangement of the fixed member and the moveable arms being such that, when the contacts close, current flowing through the movable arms produces a force which urges the movable arms towards each other thereby increasing a force between the fixed and movable contacts.

2. The electrical contactor of claim 1, wherein a pair of the movable arms extend in parallel with each other towards an outboard side of the fixed member, and the remaining single movable arm which opposes the pair of movable arms extends towards an inboard side of the fixed member.

3. The electrical contactor of claim 2, wherein the movable contacts on the pair of the movable arms are smaller than the movable contact on the remaining single movable arm.

4. The electrical contactor of claim 3, wherein, the movable contact on said one movable arm is arranged to close before the movable contacts on said two movable arms, on closing of the contactor.

5. The electrical contactor of claim 1, wherein an overall lateral extent of said movable arms at one side of the fixed member is at least substantially equal to an overall lateral extent of said movable arms at the other side of the fixed member.

6. The electrical contactor of claim 1, wherein each movable arm includes a distal extension element extending distally of the movable contact.

7. The electrical contactor of claim 6, wherein each distal extension element is angled outwardly relative to the movable contact.

8. The electrical contactor of claim 6, further comprising an actuating arrangement, including an urging member for biasing each distal extension element against outward flexion.

9. The electrical contactor of claim 8, wherein the urging member is a plurality of upstanding elongate pins or rollers which are movable longitudinally relative to the movable arms.

10. The electrical contactor of claim 8, wherein, in use, the urging member counteracts outward distal rotation of the movable contacts due to the force which urges proximal portions of the movable arms towards each other when the contacts are closed.

11. The electrical contactor of claim 8, wherein the actuating arrangement further includes a separator member arranged to separate the movable arms thereby opening the contacts, the separator member being movable from a first position at which it causes separation of the movable arms to a second position at which the movable arms are movable freely towards the fixed member.

12. The electrical contactor of claim 11, wherein the separator member is a wedge-shaped member movable longitudinally of the movable arms.

13. The electrical contactor of claim 11, wherein the actuating arrangement includes a carriage which is movable relative to the movable arms, the urging member and the separator member being disposed on the carriage whereby the movable contact is interposed therebetween.

14. The electrical contactor of claim 1, further comprising a dual-latching electromagnetic actuator for causing the contacts to close and open.

15. The electrical contactor of claim 14, wherein the dual-latching electromagnetic actuator includes a ferrite magnetic element.

16. A two-pole electrical contactor comprising:

first and second sets of terminals;

a first terminal of the first set being having an electrically-conductive fixed member with fixed contacts on opposite faces thereof;

a second terminal of the first set having a terminal body and an odd-number of electrically-conductive movable arms extending from the terminal body, each movable arm having a movable contact thereon remote from the terminal body;

the odd-number of movable arms being arranged to at least substantially oppose each other and such that their movable contacts are on either side of the fixed member and aligned with the fixed contacts;

a further first terminal of the second set being having a further electrically-conductive fixed member with fixed contacts on opposite faces thereof;

a further second terminal of the second set having a further terminal body and a further odd-number of electrically-conductive movable arms extending from the further terminal body, each movable arm having a movable contact thereon remote from the further terminal body;

the further odd-number of movable arms being arranged to at least substantially oppose each other and such that their movable contacts are on either side of the further fixed member and aligned with the fixed contacts;

the arrangement of the fixed members and the associated moveable arms being such that, when the contacts close, current flowing through the movable arms produces a force which urges the movable aims towards each other thereby increasing a force between the fixed and movable contacts.

17. The two-pole electrical contactor of claim 16, wherein each second terminal comprises a pair of said movable arms at one side of the fixed member aligned with a single said movable arm at the other side of the fixed member.

18. The two-pole electrical contactor of claim 17, wherein an overall lateral extent of said pair of movable arms at least substantially matches a lateral extent of said single movable arm.

19. The two-pole electrical contactor of claim 17, wherein the movable contacts of said pair of movable arms are smaller than the movable contact of said single movable arm.

20. The two-pole electrical contactor of claim 19, wherein the movable contact of each said single movable arm is arranged to make contact with the associated fixed contact before the movable contacts of the corresponding said pair of movable arms make contact with the associated fixed contacts when the contactor closes.

21. The two-pole electrical contactor of claim 16, wherein each movable arm includes an out-turned distal extension element extending distally of the movable contact.

22. The two-pole electrical contactor of claim 21, further comprising an actuating arrangement arranged to open and close the contacts, the actuating arrangement including a movable urging element which biases the out-turned distal extension element against outward angular displacement relative to the fixed contact.

23. The two-pole electrical contactor of claim 16, further comprising a dual-latching electromagnetic actuator for causing the contacts to close and open.

24. A movable electrical-contact set for an electrical contactor, the movable contact set comprising an odd-number of electrically-conductive movable arms and a fixed member interposed therebetween, the odd-number of movable arms each having a movable contact thereon, and the fixed member having at least one fixed contact on each side for engagement with the facing movable contacts such that, when the contacts close, current flowing through the movable arms produces a force which urges the movable arms towards each other thereby increasing a force between the movable and fixed contacts.

25. The movable electrical-contact set of claim 24, wherein two said movable arms are provided on one side of the fixed member, and a single said movable arm is provided on the other side of the fixed member, an overall lateral extent of said two movable arms matching or substantially matching a lateral extent of said single movable arm.

26. The movable electrical-contact set of claim 25, wherein the movable contacts on said two movable arms are smaller than the movable contact on said single movable arm.

27. The movable electrical-contact set of claim 24, wherein each movable arm includes an out-turned distal extension element distally of each movable contact.

28. The movable electrical-contact set of claim 27, further comprising an actuating arrangement, including an urging member for biasing each distal extension element against outward flexion.

29. The movable electrical-contact set of claim 24, wherein the movable arms extend substantially in parallel with each other to the movable contacts.

* * * * *